US009194203B1

(12) United States Patent
Lee

(10) Patent No.: US 9,194,203 B1
(45) Date of Patent: Nov. 24, 2015

(54) SUBSEA LATCH TOOL FOR CONNECTING SUBSEA COMPONENTS

(71) Applicant: Teng P. Lee, Houston, TX (US)

(72) Inventor: Teng P. Lee, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 419 days.

(21) Appl. No.: 13/790,890

(22) Filed: Mar. 8, 2013

(51) Int. Cl.
*E21B 7/12* (2006.01)
*E21B 33/038* (2006.01)

(52) U.S. Cl.
CPC ..... *E21B 33/038* (2013.01)

(58) Field of Classification Search
CPC ..... E21B 33/035; E21B 33/038
USPC ..... 166/339, 360, 368
See application file for complete search history.

(56) References Cited

U.S. PATENT DOCUMENTS 4,116,272 A 9/1978 Barrington
4,320,804 A 3/1982 Brooks
4,375,239 A 3/1983 Barrington et al.
4,436,157 A 3/1984 Brooks
4,491,346 A * 1/1985 Walker ..... 285/18
4,903,774 A * 2/1990 Dykes et al. ..... 166/363
4,969,519 A * 11/1990 Kelly ..... 166/348
6,026,905 A 2/2000 Garcia-Soule
6,260,624 B1 * 7/2001 Pallini et al. ..... 166/345
6,470,968 B1 * 10/2002 Turner ..... 166/348
6,540,024 B2 * 4/2003 Pallini et al. ..... 166/348
7,156,169 B2 * 1/2007 Bartlett ..... 166/66.7
7,743,832 B2 * 6/2010 Shaw et al. ..... 166/338
8,011,436 B2 * 9/2011 Christie et al. ..... 166/359
8,336,630 B2 12/2012 Kerr
8,474,537 B2 * 7/2013 Voss et al. ..... 166/338
8,727,012 B2 * 5/2014 Bhat ..... 166/338

* cited by examiner

*Primary Examiner* — Matthew Buck
*Assistant Examiner* — Aaron Lembo
(74) *Attorney, Agent, or Firm* — Egbert Law Office, PLLC

(57) ABSTRACT

A subsea latch tool has a latch tool body with an outer surface, a lock piston slidably mounted over the outer surface of the latch tool body and movable between an extended position and a retracted position, and a lock ring extending around the outer surface of the latch tool body. The lock piston has a wedge surface at an end thereof. The wedge surface of the lock piston is interposed between the outer surface of the latch tool body and an inner surface of the lock ring. The lock piston is movable from the retracted position to the extended position so as to expand an outer diameter of the lock ring.

9 Claims, 6 Drawing Sheets

SUBSEA LATCH TOOL FOR CONNECTING SUBSEA COMPONENTS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to latch tools that are utilized in a subsea environment. More particularly, the present invention the relates to latch tools that can be remotely engaged and disengaged. Additionally, the present invention relates to latch tools that can be utilized in association with a subsea test tree.

2. Description of Related Art Including Information Disclosed Under 37 CFR 1.97 and 37 CFR 1.98

During well testing (drilling) operations and the like, which are carried out from a floating vessel, such as a drillship or semi-submersible, well control is achieved by a subsea blowout preventer, which is mounted on the sea-bed to the wellhead. Such blowout preventers typically comprise a tubular central housing on which are mounted a number of sets of hydraulic rams. The rams are axially spaced along the housing. The lower rams, or pipe rams, are provided with semi-circular sealing faces, so that when these rams are activated the semi-circular faces mate with the outer surfaces of the well tool. The uppermost set of rams are known as shear rams and are provided with cutting surfaces which can cut through or close the bore of the well tool and isolate the pressurized reservoir fluid from the riser and the upper part of the well tool.

In oil and gas well testing, well pressure control equipment is utilized in addition to the downhole test equipment mounted at the end of the test string, the well pressure control equipment being located above the wellhead and blowout preventer on the landing string. This equipment provides various safety features and allows for complete well control.

One of the tools utilized in well testing is a subsea test tree, a safety valve which is located inside the blowout preventer. During well test operations, it is necessary to control both the tubing and annulus pressures, that is the pressure within the string and the pressure between the string and the riser, well casing and well lining. The subsea safety tree provides a primary safety system to control tubing pressure and provide means to disconnect the riser rapidly and safely from the well should adverse conditions occur, such as bad weather or loss of the positioning system of the floating vessel. This is partly achieved by providing failsafe valves in the tree, which, for example, are held open during normal operating conditions by supplied hydraulic pressure. If the hydraulic pressure is cut off, the valves will close, isolating the test string below the tree. A upper portion of the tree may be unlatched from the lower portion of the tree containing the valves, and the landing string and other well pressure control equipment located above the tree withdrawn.

In order to achieve these proper connections between the various components, latching tools are utilized. Such latching tools can take on a wide variety of configurations. It is important to the operation of any latching tool that a complete and structurally sound seal is established between the various components. Additionally, it is necessary for the latching tool to be properly hydraulically operated so that the latching tool can be easily connected and disconnected from the various components. It is very difficult to achieve the structurally sound connection while also allowing the easy connection and disconnection of the latch tool to the components. Additionally, and furthermore, the latch tool should have a secondary mechanism whereby the release of the latch tool from the component can be achieved by alternate techniques. As such, such an arrangement would avoid the necessity of deploying subsea operations in order to properly release the latch tool from the components.

In the past, various patents have issued relating to latching systems associated with subsea components, such as a test tree. For example, U.S. Pat. No. 4,116,272, issued on Sep. 26, 1978 to B. Q. Barrington, describes a hydraulically-operated subsea test tree for placement in a blowout preventer stack. A quick-release is disclosed which operates to release a stinger from a conduit leading to the surface when pressure is applied to one side of a second set of closed rams above the pressure which exists in the annulus exterior of the quick release mechanism.

U.S. Pat. No. 4,320,804, issued on Mar. 23, 1982 to R. T. Brooks, describes a latching system for use with subsea test tree. This system includes a first rocker section carryable with an upper conduit portion. A second rocker section is carryable with a second conduit portion. A lock means has a recess contoured for securement over the rocker sections and is manipulatable over the first and second rocker sections to locked and unlocked positions. Shiftable means are carried across the lock means to a first position whereby the lock means are engaged over the rocker sections and the conduit portions are secured together. A shiftable means is moved to a second position whereby the lock means are disengaged from the second rocker section and the conduit portions are in disengaged position. A second lock means is also are provided for additional securement.

U.S. Pat. No. 4,375,239, issued on Mar. 1, 1983 to Barrington et al., describes an acoustic subsea test tree and method. A hydraulically-powered latch connects and disconnects the upper and lower portions of the subsea test tree in response to acoustic command signals.

U.S. Pat. No. 4,436,157, issued on Mar. 13, 1984 to R. T. Brooks, shows a latch mechanism for subsea test tree. The test assembly provides inner and outer latching connections between upper and lower portions of a tubular conduit extending to a production zone within the well. The test assembly has a valve means in the lower conduit portion manipulatable between open and closed positions by a reciprocable actuator to control flow of fluid within the conduit. A retaining means is provided for each of the inner and outer latches to ensure that such latches may not be disengaged when the valve means is in other than an open position. The retaining means are operable by either the application of fluid pressure or through mechanical manipulation of the tubing string to be shifted to a non-retaining position relative to both the inner and outer latches. This permits selective disconnection and reconnection of the upper and lower portions of the tubular conduit.

U.S. Pat. No. 6,026,905, issued on Feb. 22, 2000 to V. Garcia-Soule, describes a subsea test tree that includes a latch head assembly, a valve assembly, and a ramlock assembly interconnected between the latch head assembly and the valve assembly. The latch head assembly may be actuated to decouple an upper portion of the tubular string from a lower portion of the tubular string. In the event of an emergency, the pipe rams may be closed on the ram lock assembly, the valves in the valve assembly may be closed, and the upper portion of the tubular string may be retrieved, or otherwise displaced away from the lower portion.

U.S. Pat. No. 8,336,630, issued on Dec. 25, 2012 to J. A. Kerr, discloses a subsea completion testing tree for connection to a tubular string which includes a lower tree portion having a control valve, an upper tree portion separably connected to the lower tree portion at a latch, a circulation valve connected with the upper tree portion, and a retainer valve connected with the upper tree portion between the circulation valve and the latch.

It is an object of the present invention to provide a subsea latch tool that can easily be engaged and disengaged from the subsea components.

It is another object of the present invention to provide a subsea latch tool that can be used in association with a subsea test tree.

It is another object of the present invention to provide a subsea latch tool which can provide a secondary or back-up mechanism for the disengagement of the subsea latch tool.

It is still another object of the present invention to provide a subsea latch tool which can be engaged and disengaged for a large number of cycles.

It is still another object of the present invention to provide a subsea latch tool which can be remotely controlled through the use of hydraulic pressure.

It is still a further object of the present invention to provide a subsea latch tool which avoids plastic deformation of the locking component.

It is still a further object of the present invention to provide a subsea latch tool which is easy to use, easy to manufacture and relatively inexpensive.

These and other objects and advantages of the present invention will become apparent from a reading of the attached specification and appended claims.

BRIEF SUMMARY OF THE INVENTION

The present invention is a subsea latch tool that comprises a latch tool body having an outer surface, a lock piston slidably mounted over the outer surface of the latch tool body and movable between an extended position and a retracted position, and a lock ring extending around the outer surface of the latch tool body. The first lock piston has a wedge surface at an end thereof. The wedge surface of the first lock piston is interposed between the outer surface of the latch tool body and an inner surface of the lock ring. The first lock piston is movable from the retracted position to the extended position so as to expand an outer diameter of the lock ring.

A piston retainer can be affixed to the latch tool body and positioned at an end of the first lock piston opposite the wedge surface. A first fluid channel extends through the latch tool body so as to open to the end of the first lock piston. The first fluid channel is suitable for passing a fluid so as to move the first lock piston from the retracted position to the extended position.

The latch tool body has a shoulder formed at the outer surface. The first lock piston has an inner surface. A second fluid channel extends through the latch tool body so as to open to the inner surface of the first lock piston. The second fluid channel is suitable for passing the fluid so as to move the first lock piston from the extended position to the retracted position. A second lock piston is slidably positioned over the outer surface of the latch tool body. The second lock piston is positioned within the inner surface of the first lock piston. The second lock piston is movable between a first position adjacent the shoulder of the latch tool body and a second position adjacent a shoulder at the inner surface of the first lock piston. A third fluid channel extends through the latch tool body so as to open toward the inner surface of the first lock piston and adjacent the shoulder of the latch tool body. The third fluid channel is suitable for passing the fluid so as to move the second lock piston toward the shoulder at the inner surface of the first lock piston. A fourth fluid channel extends through the latch tool body so as to open at the outer surface of the latch tool body and toward the inner surface of the first lock piston. The fourth fluid channel is suitable for passing a fluid so as to test that the first lock piston is in a fully extended position.

A latch tool nose is affixed to the outer surface of the latch tool body. The lock ring has an end surface bearing against the latch tool nose. The latch tool body has a notch extending circumferentially therearound. The lock ring has a tongue extending inwardly thereof. The tongue received in the notch. The inner surface of the lock ring has a plurality of tongues extends radially inwardly therefrom. The plurality of tongues are in spaced relationship to each other and are received in the notch of the latch tool body. The plurality of tongues each have an inner edge with side edges extending therefrom and toward the inner surface of the lock ring. Each of the side edges has an arcuate contour such that the tongue widens towards the inner surface of the lock ring.

The lock ring has a split extending entirely through a thickness of the lock ring so as to define a space between edges of the lock ring. The space widens as the first lock piston moves toward the extended position so as to expand the outer diameter of lock ring. The lock ring has a first tooth and a second tooth in spaced relationship on an outer surface of the lock ring. The first tooth extends circumferentially around the lock ring. The second tooth extends circumferentially around the lock ring. The lock ring has an indented area formed between the first tooth and the second tooth and extends circumferentially around the lock ring. The inner surface of the lock ring has a slide surface formed at an upper end thereof. The wedge surface is slidable along the slide surface as the first lock piston moves from the retracted position to the extended position.

The present invention is also a subsea assembly that comprises a first subsea component having a connector at an end thereof, a second subsea component having a receptacle at an end thereof, and a latch tool having one end affixed to the connector of the first subsea component. The latch tool has an opposite end received in the receptacle of the second subsea component. The latch tool comprises a latch tool body having an outer surface, a first lock piston slidable mounted over the outer surface of the latch tool body and movable between an extended position and a retracted position, and a lock ring extending around the outer surface of the latch tool body. The first lock piston is movable to the extended position so as to expand an outer diameter of the lock ring such that the lock ring engages the receptacle of the second subsea component.

The first lock piston is movable from the extended position to the retracted position so as to reduce the outer diameter of the lock ring such that the lock ring disengages from the receptacle of the second subsea component. The receptacle of the second subsea component has an abutment surface extending inwardly therefrom. The lock ring has a tooth extends circumferentially around the outer diameter of the lock ring. This tooth abuts the abutment surface when the outer diameter of the lock ring is expanded.

The lock ring has a split extending entirely through a thickness of the lock ring so as to form a space between edges of the lock ring. The latch tool body has a notch extending circumferentially therearound. The lock ring has a plurality of tongues extending inwardly from the inner surface of the lock ring. The plurality of tongues are spaced from each other around an inner diameter of the lock ring. The notch receives the plurality of tongues of the lock ring therein.

The first lock piston has a wedge surface at an end thereof. This wedge surface is positioned between the outer surface of the latch tool body and an inner surface of the lock ring. The wedge surface movable along the inner surface of the lock ring as the first lock piston moves from the retracted position to the extended position.

This foregoing Section is intended to described, in generality, the preferred embodiment of the present invention. It is understood that modifications to this preferred embodiment can be made within the scope of the present invention. As such, this Section should not to be construed, in any way, as limiting of the broad scope of the present invention. The present invention should only be limited by the following claims and their legal equivalents.

DETAILED DESCRIPTION OF THE INVENTION

Figure 1:
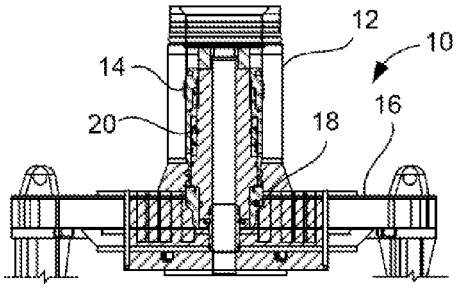
FIG. 1 is a cross-sectional view showing the application of the subsea latch tool of the present invention between a first subsea component and a second subsea component.

Referring to FIG. 1, there is shown the subsea assembly 10 in accordance with the teachings of the present invention. The subsea assembly 10 includes a first subsea component 12 having a connector 14 at an end thereof. A second subsea component 16 has a receptacle 18 at an end thereof. The subsea latch tool 20 of the present invention has one end affixed to the connector 14 of the first subsea component 12 and an opposite end received in the receptacle 18 of the second subsea component 16. As can be seen in FIG. 1, the first subsea component 12 is a subsea test tree. The second subsea component 16 is a wellhead completion cap. It should be noted that the structure of the subsea latch tool 20 of the present invention can be utilized in association with a variety of subsea components. The subsea latch tool of the present invention is most applicable, however, for use in association with subsea test trees.

In FIG. 1, the second subsea component 18 will have an abutment surface at the receptacle 18. The subsea latch tool 20 will have a lock ring with a surface that bears against the abutment surface in the receptacle 18 of the second subsea component 16. As such, the subsea latch tool 20 establishes a structurally sound connection between the first subsea component 12 and the second subsea component 16. Suitable hydraulic mechanisms, as will be described hereinafter, are operable so as to release the lock ring from the engagement with the abutment surface in the receptacle 18 of the second subsea component 16.

Figure 2:
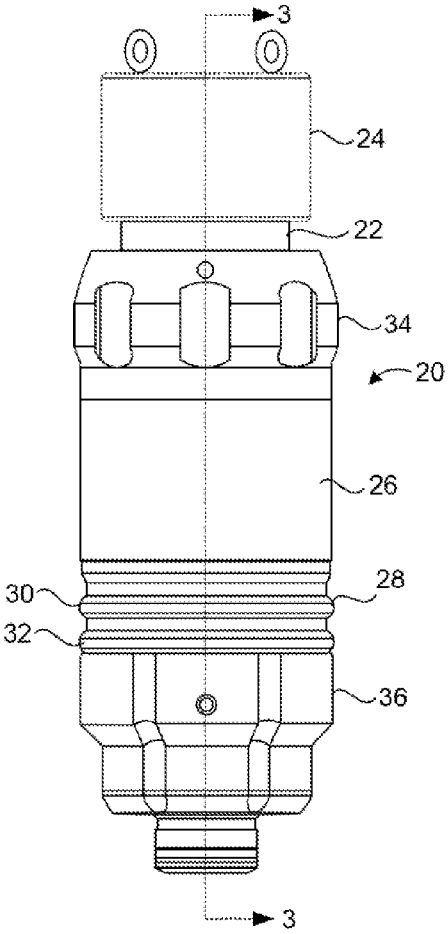
FIG. 2 is a side elevational view of the subsea latch tool in accordance with the preferred embodiment of the present invention.

FIG. 2 shows a subsea latch tool 20 in accordance with the preferred embodiment of the present invention. The subsea latch tool 20 has a latch tool body 22. A test adaptor 24 is affixed to the upper end of the latch tool body 22. A first lock piston 26 extends over the outer surface of the latch tool body 22. As will be described hereinafter, first lock piston 26 can be movable so as to cause a lock ring 28 to expand outwardly so that the teeth 30 and 32 of the lock ring 28 are suitable for engaging the abutment surfaces associated with receptacle 18 of the second subsea component 16. A piston retainer 34 extends over the outer surface of the latch tool body 28. The piston retainer 34 is in a fixed position. As such, the first lock piston 26 can bear against the pistons retainer 34. A latch tool nose 36 is affixed over the outer surface of the latch tool body 22 and is located at the bottom of the lock ring 28. The latch tool nose 36 has a surface that bears against the lock ring 28. As will be described hereinafter, when the first lock piston 26 moves in the direction toward the latch tool noes 36, the lock ring 28 will have an outer diameter that expands outwardly such that the teeth 30 and 32 can engage respective abutment surfaces associated with the receptacle 18 of the second subsea component 16. As such, a locked configuration is achieved. When the first lock piston 26 is moved in the direction toward the piston retainer 34, the outer diameter of the lock ring 28 will be reduced so as to allow for a releasing of the teeth 30 and 32 from the respective abutment surfaces associated with receptacle 18 of the second subsea component 16. As such, the present invention is able to achieve a positive engagement and a positive disengagement from the receptacle 18 of the second subsea component.

Figure 3:
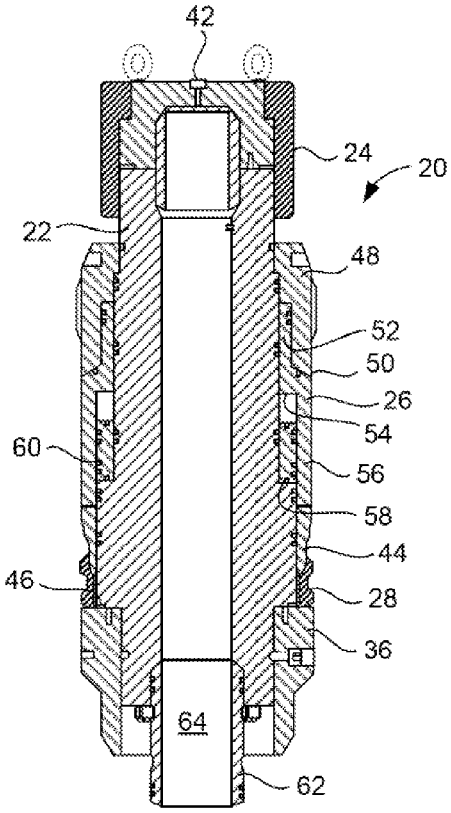
FIG. 3 is a cross-sectional view of the subsea latch tool of the present invention as taken across lines 3-3 of FIG. 2.

FIG. 3 is a cross-sectional view showing the subsea latch tool 20 of the present invention. Initially, it can be seen that the latch tool body 22 extends longitudinally. There is a bore 40 which extends through the interior of the latch tool body 22. The test adaptor 24 is a fixed over the upper end of the latch tool body 22. The test adaptor includes a port 42 which communicates with the flow passageway 40 of the latch tool body 22.

The first lock piston 26 is slidably mounted over the outer surface of the latch tool body 22. The first lock piston 26 will be movable between an extended position and a retracted position. The first lock piston 26 is illustrated in FIG. 3 in its retracted position. The first lock piston 26 will have a wedge surface 44 located at a lower end thereof. The lock ring 28 is located below the first lock piston 26 and is positioned so as to have a lower end in abutment with the latch tool nose 36. It can be seen that the wedge surface 44 is sandwiched between a portion of the lock ring 28 and the outer surface of the latch tool body 22. Importantly, there is a notch 46 which is formed circumferentially around the latch tool body 22 generally adjacent to the latch tool nose 36. This notch 46 is suitable for receiving tongues extending inwardly from the inner surface of the lock ring 28. As such, the lock ring 28 can be positively retained in its position against the latch tool nose 36 and will avoid being released and sliding with the wedge surface 26 when the first lock piston 26 moves to its retracted position.

A piston retainer 48 is affixed to the latch tool body 22 and positioned at an end of the first lock piston 26 opposite the wedge surface 44. The piston retainer 36 can be threadedly secured to the outer diameter of the latch tool body 22 or otherwise permanently fixed in position therewith. The piston retainer 48 has an end surface 50 that can bear against a shoulder of the first lock piston 26 when the first lock piston 26 is in its retracted position.

The first lock piston 26 will have a first portion 52 which bears against the outer surface of the latch tool body 22. There is a shoulder 54 formed in the first lock piston 26 so as to extend away from the outer surface of the latch tool body 22. This shoulder 54 extends to another portion 56 of the first lock piston 26 so as to define a space between the inner surface of the first lock piston 26 and the outer surface of the latch tool body 22. The latch tool body 22 also has a shoulder 58 which extends outwardly therefrom. Shoulder 58 will further define the space. This shoulder 58 will extend to a wider diameter portion of the latch tool body 22 such that the inner surface of the portion 56 of the first lock piston 28 can bear thereagainst in surface-to-surface contact. It can be seen in FIG. 3 that there are a variety of seals which extend between the bearing surfaces of the first lock piston 26 and the outer surface of the latch tool body 22.

In FIG. 3, there is a second lock piston 60 that is slidably positioned in the space defined by the shoulder 54, the shoulder 58, the outer surface of the latch tool body 22 and the inner surface of the first lock piston 26. The second lock piston is slidably positioned over the outer surface of the latch tool body 22. This second lock piston 60 will be slidably movable between a first position adjacent the shoulder 58 of the latch tool body 22 and the shoulder 54 of the first lock piston 26. As such, this second lock piston can be utilized so as to move so as to effectively unlock the lock ring 28 from its engagement with the abutment surface of the receptacle 18 of the second subsea component.

In FIG. 3, it can further be seen that there is seal sub 62 positioned at the bottom of the latch tool body 22. This seal sub 62 will have an interior passageway 64 which is aligned with the flow passageway 40 of the latch tool body 22.

Figure 4:
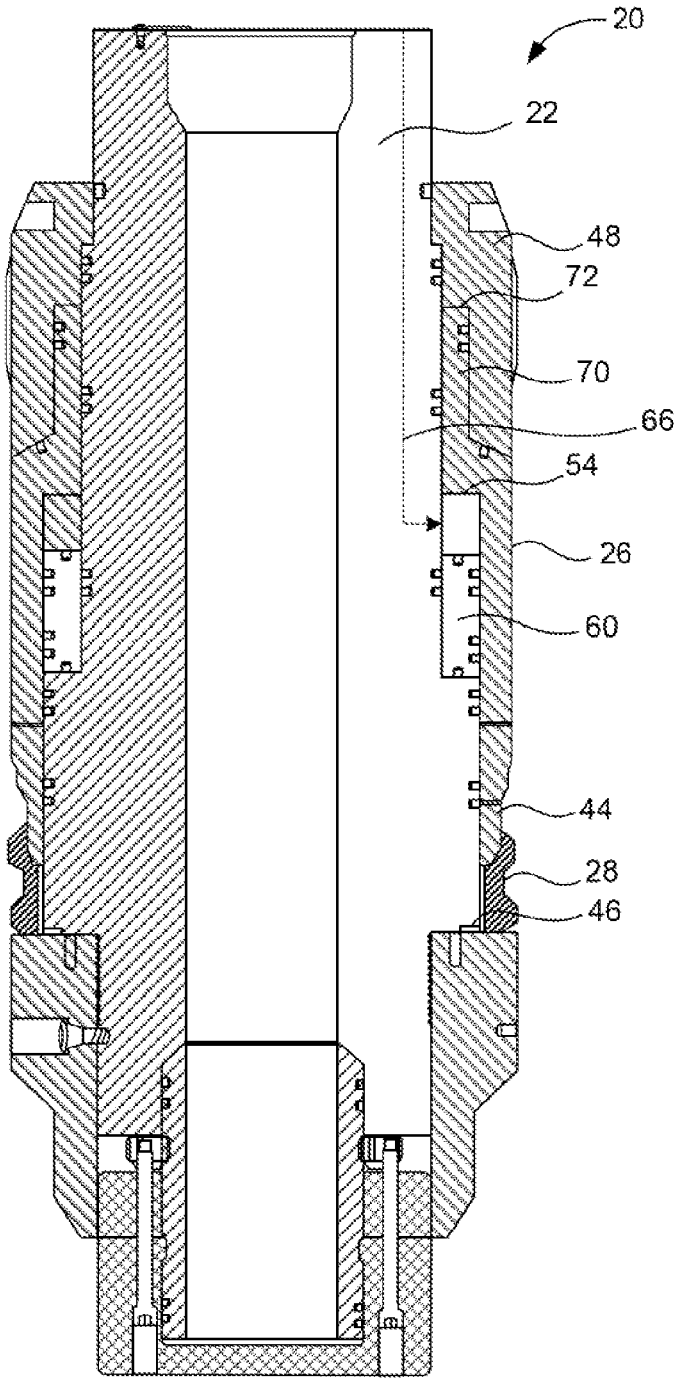
FIG. 4 is a partially cross-sectional view of the subsea latch tool of the present invention showing the use of hydraulic fluid for moving the first lock piston to the retracted position.

FIG. 4 is an illustration of the subsea latch tool 20 of the present invention in which hydraulic pressure is applied so as to cause the first lock piston 26 to move to its retracted position. As can be seen, the fluid channel 66 extends through the latch tool body 22 so as to open toward the inner surface of the first lock piston 26. In particular, the fluid channel 66 will open to the space between the second lock piston 60 and the shoulder 54 of the first lock piston 26. As such, hydraulic pressure can be applied so as to urge the first lock piston 26 upwardly such that the wedge surface 44 will reside between the lock ring 28 and the outer surface of the latch tool body 22 at an upper end of the lock ring 28. As such, the lock ring 28 will return to its minimum diameter configuration. The upper end 70 of the first lock piston 26 will reside against the shoulder 72 formed on the inner surface of the piston retainer 48. As such, the travel of the first lock piston 26 will be limited to avoid any separation between the wedge surface 44 and the lock ring 28. The tongues associated with the lock ring 28 (to be described hereinafter) continue to be retained within the notch 46 of the latch tool body 22. As such, any friction between the wedge surface 44 and the inner surface of the lock ring 28 will not cause the lock ring 28 to move upwardly with the movement of the first lock piston 26.

Figure 5:
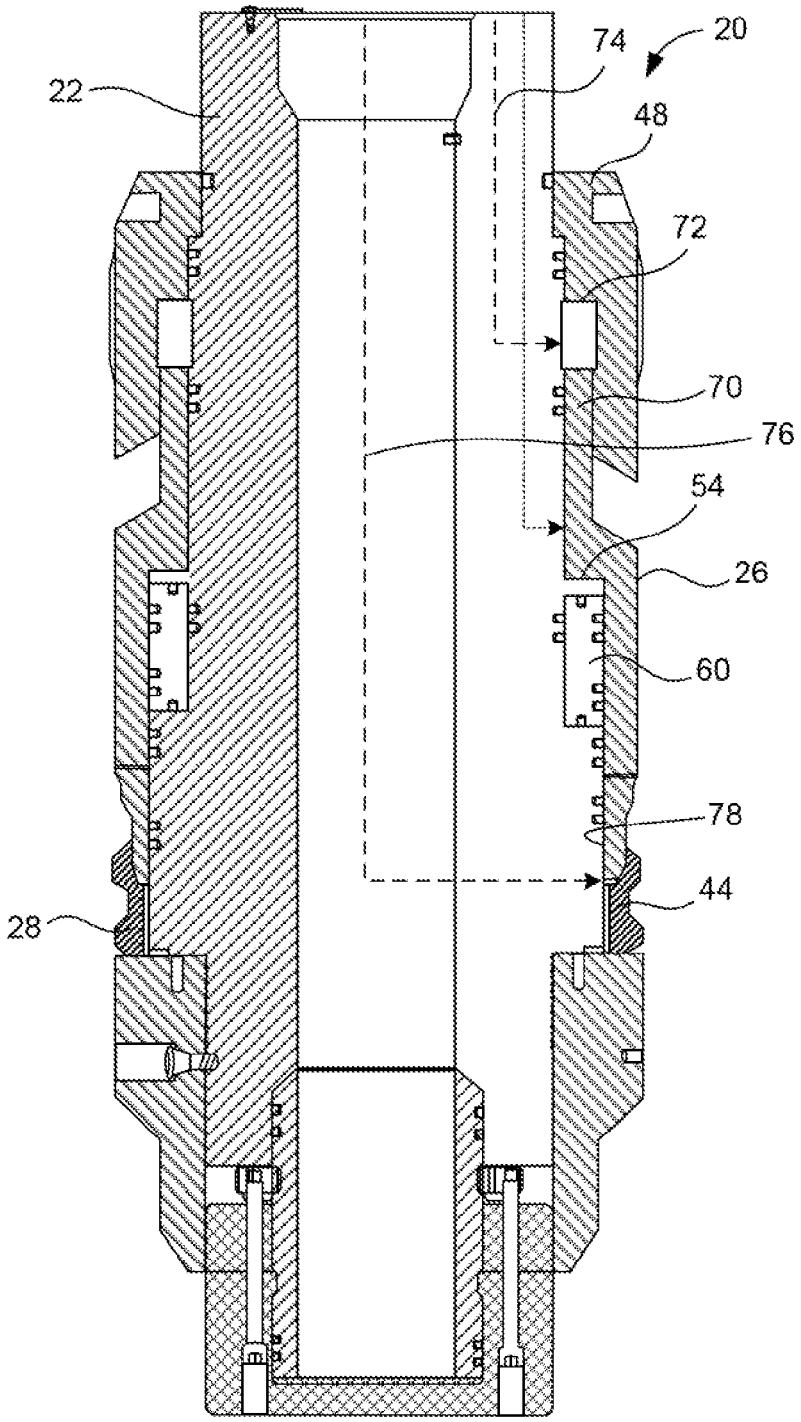
FIG. 5 is a partially cross-sectional view of the subsea latch tool of the present invention showing the flow of hydraulic fluid for the locking of the latch tool and for the testing of the lock.

FIG. 5 shows the subsea latch tool 20 of the present invention in its locking configuration. Initially, it can be seen that there is fluid channel 74 that extends through the latch tool body 22 so as to open to the space between the shoulder 72 of the piston retainer 48 and the upper end 70 of the first lock piston 26. The force of the hydraulic pressure in this space will cause the first lock piston 26 to move downwardly such that the wedge surface 44 will push further into the space between the inner surface of the lock ring 28 and the outer surface of the latch tool body 22. This force will flex the lock ring 28 outwardly so as to expand the outer diameter of the lock ring 28. As such, the lock ring 28 will be in a suitable position so as to lock with the abutment surfaces associated with the receptacle 18 of the second component 16.

The shoulder 54 will move so as to eventually approach or bear against the upper end of the second lock piston 60. As such, the second lock piston 60 will limit the downward travel of the first lock piston 26 during the locking operation. Another fluid channel 76 will also extend through the latch tool body 22 so as to have an opening at a location 78 of the latch tool body 22. This is a "lock verify" location. After the locking operation is carried out by passing hydraulic fluid through fluid channel 74, it will be necessary to verify that the lock ring 28 is in a properly expanded and locked configuration. As such, fluid pressure is introduced through the fluid channel 76. If the pressure test shows that there is a leakage of fluid or that no pressure is retained, then it can be assured that the lock ring 28 is in its proper position. However, if the fluid in the fluid channel 78 becomes pressurized, then this is an indication that a proper locking operation has not occurred. As such, the fluid channel 76 functions so as to verify the locking operation.

Figure 6:
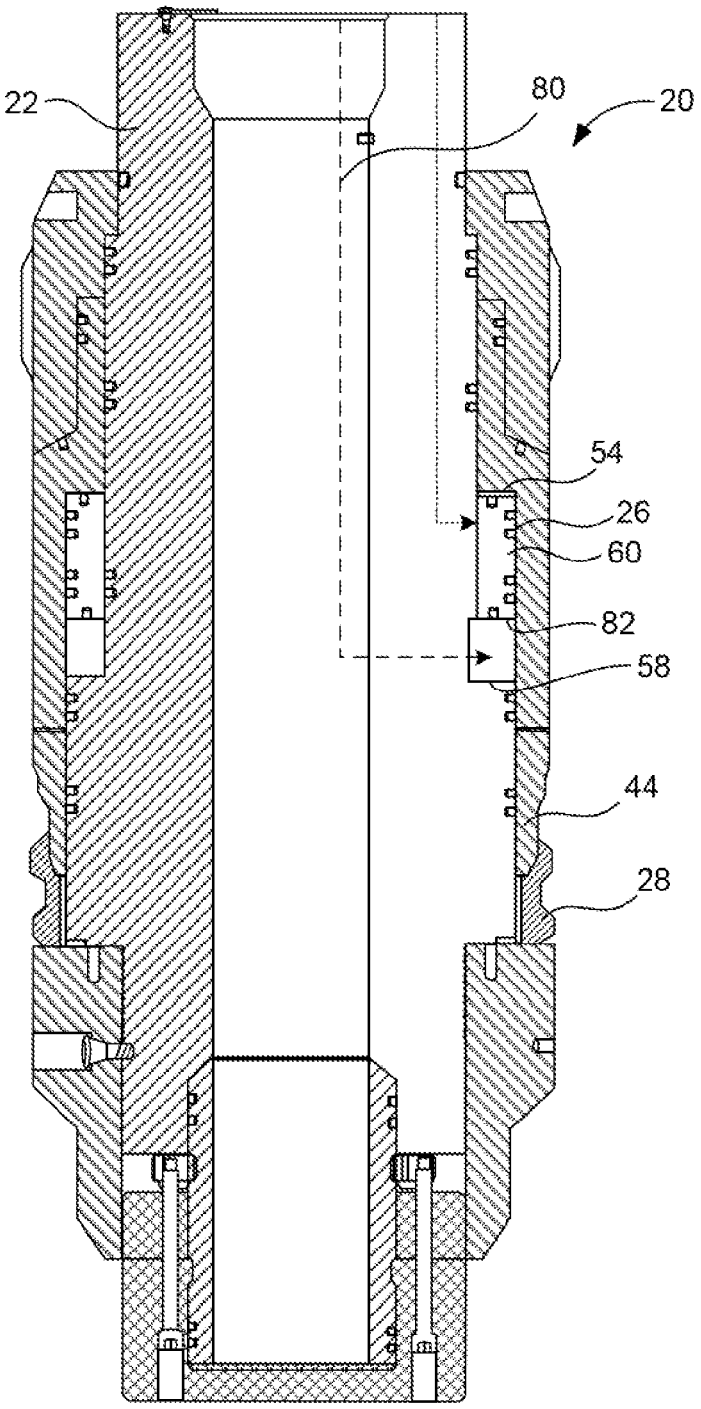
FIG. 6 is a partially cross-sectional view of the subsea latch tool of the present invention showing the flow of hydraulic fluid for the operation of the backup mechanism for the release of the lock.

FIG. 6 shows the subsea latch tool 20 of the present invention in which the secondary disengaging mechanism is operated. It should be noted that, under certain circumstances, the operation of disengaging the lock ring 28 may not be effectively achieved. This can occur by friction forces, by inadequate pressures, by blockages in the fluid channel, or for other reasons. Under those circumstances when a proper disengagement has not be achieved (in the manner shown in FIG. 4), then significant problems occur. Ultimately, it could require that submersibles or divers be utilized so as to facilitate the release of the lock ring 28. The present invention addresses such a problem by providing a secondary or backup technique for the disengagement of the lock ring.

In FIG. 6, it can be seen that the fluid channel 80 extends through the latch tool body 22 so as to open to a space between the bottom end 82 of the second lock piston 60 and the shoulder 58 of the latch tool body 22. The fluid pressure applied through the fluid channel 80 will cause the second lock piston 60 to move upwardly so as to bear against the shoulder 54 of the first lock piston 26. This can be utilized so as to provide additional pressure so as to force the first lock piston 26 upwardly such that the wedge surface 44 moves upwardly in the lock ring 28 so as to cause the lock ring 28 to move its minimum diameter configuration.

Figure 7:
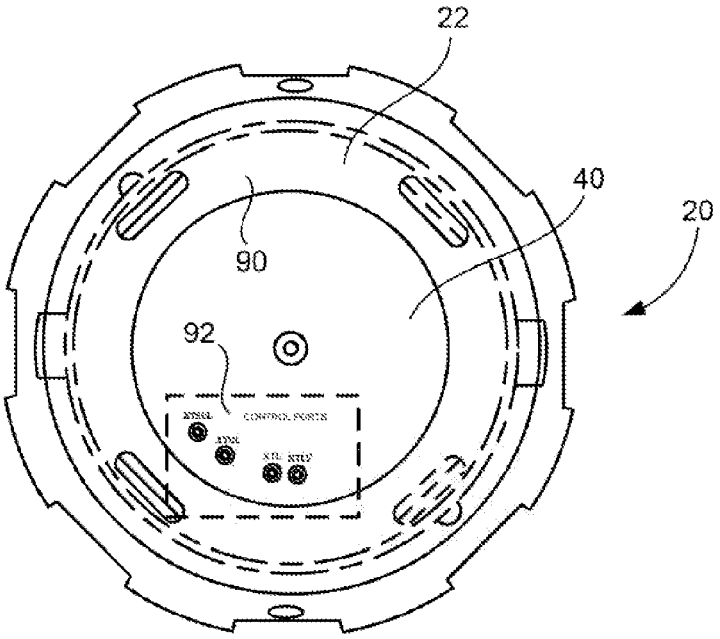
FIG. 7 is plan view of the subsea latch tool of the present invention.

FIG. 7 shows a plan view of the subsea latch tool 20 of the present invention. As can be seen, the latch tool body 22 has an upper end 90. The flow passageway 40 extends through the interior of the latch tool body 22. A plurality of ports 92 are formed in the latch tool body 22 so as to connect with the fluid channels 66, 74, 76 and 80 (as shown in previous FIGS. 4-6).

Figure 8:
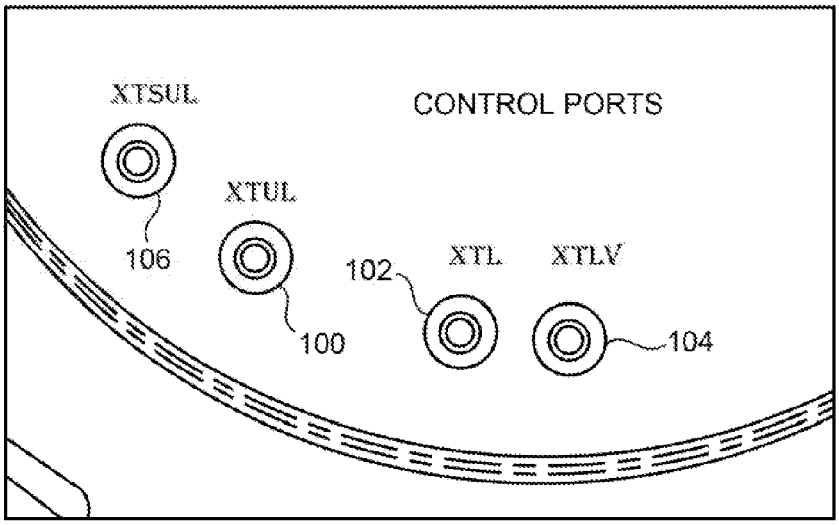
FIG. 8 is a magnified view of the control ports as used in the subsea latch tool of the present invention.

FIG. 8 shows this arrangement of ports. A first port 100 can be connected to the fluid channel 66. The term "XTUL" means "Christmas tree unlock". As such, port 100 can be utilized so that hydraulic fluid can be introduced through the fluid channel 66 for the unlocking of the subsea latch tool 20. Port 102 is identified as "XTL" (which means "Christmas tree lock"). As such, fluid can be introduced through port 102 so as to pass through fluid channel 74 for the locking of the lock ring 28. Port 104 is identified as "XTLV" (which means "Christmas tree lock verify"). Port 104 will be connected with fluid channel 76 so as to verify that a proper locking of the lock ring with the subsea component has been achieved. A port 106 is identified as "XTSUL" (which means "Christmas tree secondary unlock"). Port 106 is suitable for connection to the fluid channel 80 so as to facilitate the secondary unlocking of the lock ring.

Figure 9:
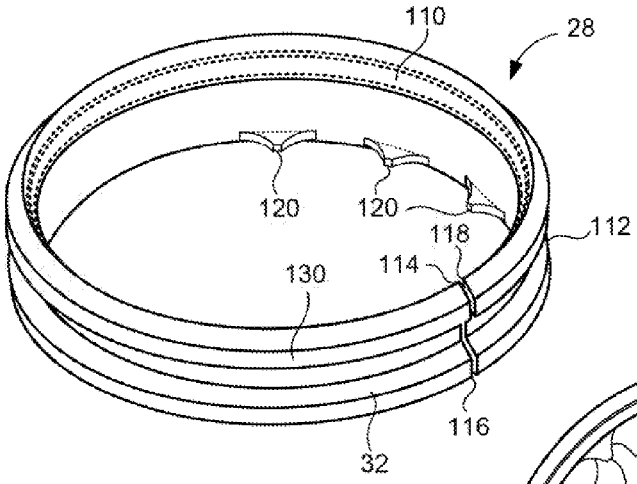
FIG. 9 is a perspective view of the lock ring as used in the subsea latch tool of the present invention.

FIG. 9 is an isolated view of the lock ring 28 as used in the present invention. The lock ring 28 is an annular member having an inner surface 110 and an outer surface 112. A split 114 is formed through the thickness of the lock ring 28 so as to define a space between the adjacent edges 116 and 118 of the lock ring 28. In FIG. 9, the lock ring 28 is illustrated in its minimum diameter configuration. When forces are applied to the inner surface 110 of the lock ring 28 through the use of the wedge surface 44 of the first lock piston 26, the outer diameter of the lock ring 28 will expand so that the space between the edges 116 and 118 at split 114 will move away from each other. This will, in effect, "flex" the lock ring 28 so that the teeth 30 and 32 will effectively engage with the abutment surface associated with the receptacle 18 of the second subsea component 16.

In FIG. 9, it can be seen that there are a plurality of tongues 120 which extend radially inwardly from the inner surface 110 of the lock ring 28. These tongues 120 will be received within the notch 46 formed circumferentially in the latch tool body 22. As such, the tongues 120 serve to assure that the lock ring 28 is secured in position.

Figure 10:
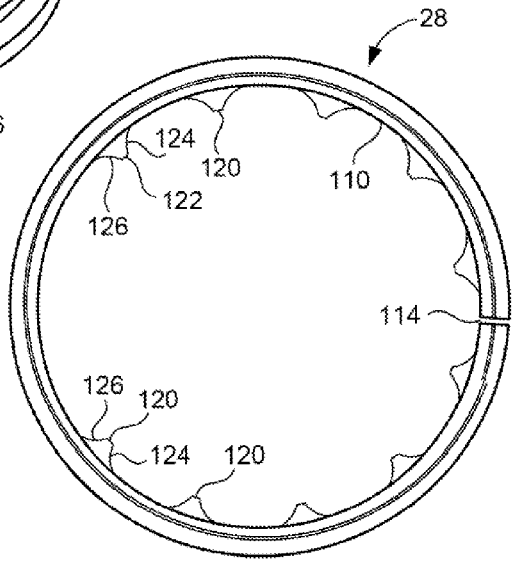
FIG. 10 is a plan view of the lock ring as used in the subsea latch tool of the present invention.

FIG. 10 illustrates the lock ring 28. As can be seen, each of the tongues 120 extends radially inwardly from the inner surface 110 of the lock ring 28. In particular, there are a total of five tongues 120 located on one side of the split 114 and a total of five tongues that are located on the opposite side of the split 114. Each of the tongues 120 includes an inner edge 122 of a generally flat configuration. Side edges 124 and 126 extend from the inner edge 120 toward the inner surface 110 of the lock ring 28. Each of these side edges 124 and 126 is of an arcuate shape so as to widen toward the inner surface 110.

It should be noted that the unique configuration of the tongues 120 facilitates the operation of the present invention. These spacing of the various tongues around the inner diameter of the lock ring 28 facilitates the ability of the lock ring 28 to properly flex between the expanded position and the retracted position. It should be noted that none of the tongues 120 reside on the inner surface 110 of the lock ring 28 opposite the split 114. As such, the tongues 120 serve to effectively retain the lock ring 28 within the notch 46 of the latch tool body 22 while facilitating proper flexing. If any additional structure where provided along the inner surface 110, then it is likely that plastic deformation of the lock ring 28 would occur. Any plastic deformation would cause the lock ring 28 to no longer properly flex inwardly and outwardly through operation of the first lock piston 26. Additionally, the arcuate configuration of the sides 124 and 128 has been further found to enhance the ability of the lock ring 28 to flex without any plastic deformation. As such, the use of the tongues 120 assures proper bendability of the lock ring 28 while also ensuring proper retainability of the lock ring 28.

FIG. 10 illustrates a cross-sectional view of the lock ring 28. Initially, it can be seen that the inner surface 110 of the lock ring 28 has the tongues 120 extending inwardly therefrom. A slide surface 130 is formed adjacent to the upper end 132 of the lock ring 28. Slide surface 130 provides an area in which the wedge surface 44 is initially retained. As a downward force is applied to the first lock piston 26, the wedge surface 44 will move along the slide surface 130 so as to urge the walls of the lock ring 28 outwardly. The end of the wedge surface 44 will be seated against the slide surface 130 when the first lock piston 26 is in its retracted position.

Figure 11:
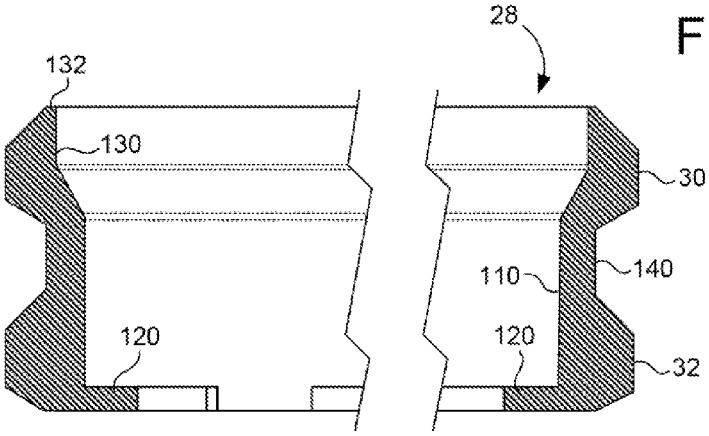
FIG. 11 is cross-sectional view of the lock ring as used in the subsea latch tool of the present invention.

FIG. 11 also shows that the lock ring 28 includes a first tooth 30 and a second tooth 32 with an indented area 140 formed therebetween. The first tooth 30 extending circumferentially around the outer diameter of the lock ring 28. The second tooth 32 also extends circumferentially around the outer diameter of the lock ring 28. The indented area 140 also extends circumferentially around the lock ring 28.

The use of the two teeth 30 and 32 allows a better distribution of forces when the lock ring 28 is in its engaged position. The use of the two teeth 30 and 32 assures of a greater contact area. The use of these two teeth instead of a single tooth minimizes the amount of expansion of the lock ring 28 that is necessary to achieve a lock. The use of the two teeth 30 and 32 provides the lock ring 28 with a reduced thickness. As such, this avoids any plastic deformation of the lock ring 28 while also allowing greater bendability.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A subsea latch tool comprising:

a latch tool body having an outer surface;

a first lock piston slidably mounted over said outer surface of said latch tool body, said first lock piston movable between an extended position and a retracted position, said first lock piston having a wedge surface at an end thereof;

a lock ring extending around said outer surface of said latch tool body, said wedge surface of said first lock piston interposed between said outer surface of said latch tool body and an inner surface of said lock ring, said first lock piston movable from said retracted position to said extended position so as to expand an outer diameter of said lock ring;

a first fluid channel extending through said latch tool body so as to open to said end of said first lock piston, said first fluid channel suitable for passing a fluid so as to move said first lock piston from said retracted position to said extended position, said latch tool body having a shoulder formed at said outer surface, said first lock piston having an inner surface;

a second fluid channel extending through said latch tool body so as to open said inner surface of said first lock piston, said second fluid channel suitable for passing the fluid so as to move the first lock piston from said extended position to said retracted position;

a second lock piston slidably positioned over said outer surface of said latch tool body, said second lock piston positioned within said inner surface of said first lock piston, said second lock piston movable between a first position adjacent said shoulder of said latch tool body and a second position adjacent a shoulder at said inner surface of said first lock piston;

a third fluid channel extending through said latch tool body so as to open toward said inner surface of said first lock piston and adjacent said shoulder of said latch tool body, said third fluid channel suitable for passing the fluid so as to move second lock piston toward said shoulder at said inner surface of said first lock piston; and a fourth fluid channel extending through said latch tool body so as to open at said outer surface of said latch tool body and toward said inner surface of said first lock piston, said fourth fluid channel suitable for passing a fluid so as to test that said first lock piston is in a fully extended position.

2. The subsea latch tool of claim 1, further comprising:

a latch tool nose affixed to said outer surface of said latch tool body, said lock ring having an end surface bearing against said latch tool nose.

3. The subsea latch tool of claim 1, said latch tool body having a notch extending circumferentially therearound, said lock ring having a tongue extending inwardly thereof, said tongue received in said notch.

4. The subsea latch tool of claim 3, said inner surface of said lock ring having a plurality of tongues extending radially inwardly therefrom, said plurality of tongues received in said notch of said latch tool body.

5. The subsea latch tool of claim 4, each of said plurality of tongues having an inner edge with side edges extending therefrom and towards said inner surface of said lock ring.

6. The subsea latch tool of claim 5, each of said side edges having an arcuate contour such that said tongue widens towards said inner surface of said lock ring.

7. The subsea latch tool of claim 1, said lock ring having a split extending entirely through a thickness of said lock ring so as to define a space, said space widening as said first block piston moves toward said extended position so as to expand the outer diameter of said lock ring.

8. The subsea latch tool of claim 1, said lock ring having a first tooth and a second tooth in spaced relationship, said first tooth extending circumferentially around said lock ring, said second tooth extending circumferentially around said lock ring, said lock ring having an indented area formed between said first tooth and said second tooth, said indented area extending circumferentially around said locking ring.

9. The subsea latch tool of claim 1, said inner surface of said locking ring having a slide surface formed at an upper end thereof, said wedge surface slidable along said slide surface as said first lock piston moves from said retracted position to said extended position.

* * * * *